United States Patent [19]

Cullen

[11] 4,358,143

[45] Nov. 9, 1982

[54] ROLL LIFT AND TRANSFER APPARATUS

[75] Inventor: Ralph E. Cullen, Shorewood, Minn.

[73] Assignee: Central Machine Corporation, Minneapolis, Minn.

[21] Appl. No.: 200,389

[22] Filed: Oct. 24, 1980

[51] Int. Cl.[3] ..... B66C 1/02; B66C 1/54

[52] U.S. Cl. ..... 294/64 R; 242/41; 242/81; 294/93; 414/626; 414/684; 414/911

[58] Field of Search ..... 294/64 R, 65, 67 A, 294/67 C, 86 LS, 88, 93–97, 103 CG; 242/35.5 A, 41, 79, 81; 414/627, 684, 783, 908, 910, 911, 626

[56] References Cited

U.S. PATENT DOCUMENTS

| | | | |
|---|---|---|---|
| 1,868,562 | 7/1932 | Chubb et al. . | |
| 2,193,765 | 3/1940 | Krengel | 242/79 X |
| 2,767,932 | 10/1956 | Valin | 414/684 X |
| 2,770,380 | 11/1956 | Anderson . | |
| 2,841,300 | 7/1958 | Berquist . | |
| 2,932,420 | 4/1960 | Mako et al. . | |
| 3,042,335 | 7/1962 | Ensign et al. | 242/81 |
| 3,263,938 | 8/1966 | Dalglish . | |
| 3,264,029 | 8/1966 | Bellmann . | |
| 3,391,876 | 7/1968 | Dalglish . | |
| 3,423,120 | 1/1969 | Dalglish . | |
| 3,424,398 | 1/1969 | Garnier | 242/81 |
| 3,445,076 | 5/1969 | Dalglish . | |
| 3,734,328 | 5/1973 | Dalglish . | |
| 3,737,050 | 6/1973 | Leeuwestein | 294/67 C X |
| 3,758,144 | 9/1973 | Dalglish . | |
| 3,771,666 | 11/1973 | Fournier . | |
| 3,881,603 | 5/1975 | Stotler et al. | 242/35.5 A X |
| 3,999,665 | 12/1976 | Rogers | 414/911 X |
| 4,154,470 | 5/1979 | Dalglish | 294/93 |

*Primary Examiner*—Johnny D. Cherry

*Attorney, Agent, or Firm*—Merchant, Gould, Smith, Edell, Welter & Schmidt

[57] ABSTRACT

The disclosure is directed to apparatus (11) for lifting, maneuvering and transferring a roll of material to an independently supported shaft (93). The apparatus is adapted for suspension from an overhead crane and comprises an elongated frame (12) the lower end of which is pivotally connected to a torque assembly (14) that includes a center probe (15). The center probe includes a plurality of radially expanding teeth (49) that engage the inner surface of the roll core and retain it on the center probe (15). An actuator (13) of the extensible-retractable type is pivotally connected between the upper end of the elongated frame (12) and one end of the torque arm assembly (14). Extension and retraction of the actuator (13) causes the torque arm assembly (14) and center probe (15) to move between substantially vertical and horizontal positions. The extreme end of the center probe includes a coupler (61) that releasably interlocks with a coupler (94) secured to the end of the machine shaft (93). The couplers permit the center probe and machine shaft to be interlocked in coaxial relation. A circular vacuum plate (67) is axially movable by pneumatic actuators (82, 83) between a retracted position in which a roll of material may be received on the center probe, and an extended position in which the roll of material is forceably transferred from the center probe to the machine shaft (93).

23 Claims, 9 Drawing Figures

Fig. 7
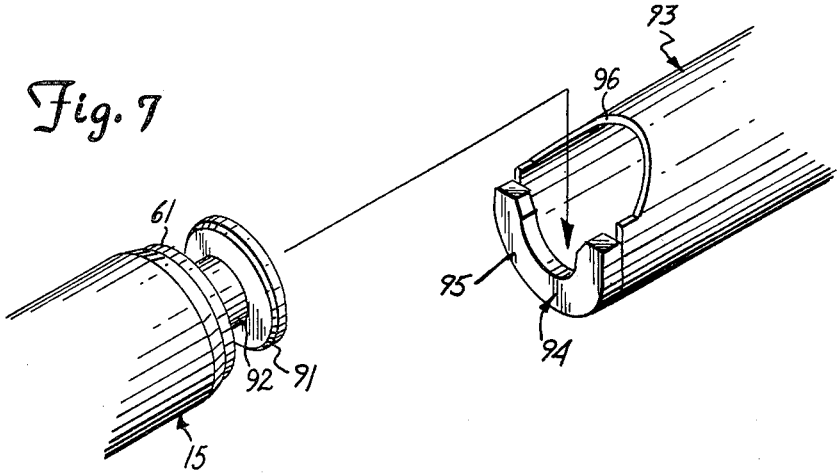
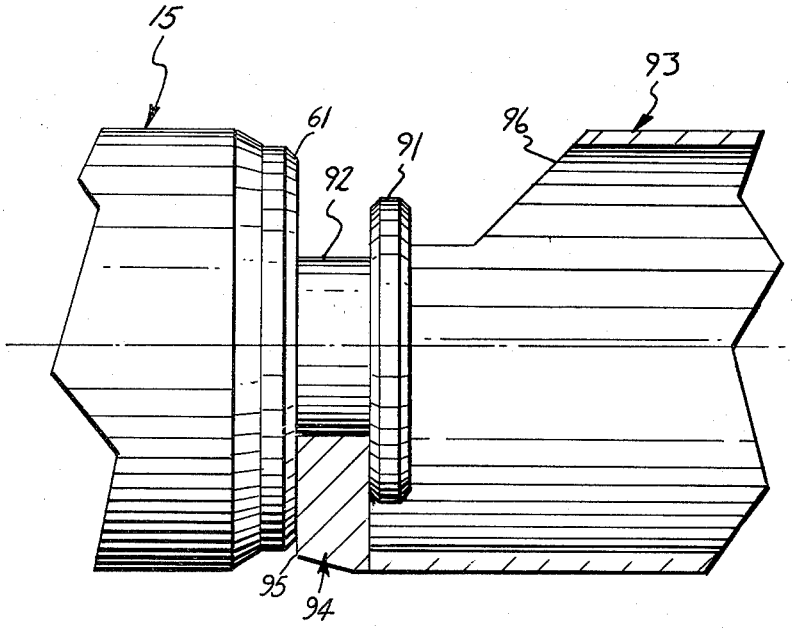
Fig. 8

ROLL LIFT AND TRANSFER APPARATUS

TECHNICAL FIELD

The invention is generally related to apparatus for lifting and maneuvering a roll of material having an externally accessible axial opening, and is specifically directed to apparatus of this type which is capable of transferring a roll of material to and from an independently supported shaft, such as the shaft of a winding-/unwinding machine.

BACKGROUND OF THE INVENTION

Many products, such as paper, film, foil, textile, sheet metal, rope, yarn and wire are wound on rolls, coils, reels or spools which weigh from 50 to 10,000 pounds. Many cannot be lifted or maneuvered manually and require the intervention of some type of powered lifting apparatus.

A number of power lifting devices and related structures are known. See, for example, U.S. Pat. Nos. 3,263,938, 3,391,876, 3,423,120, 3,445,076, 3,734,328, 3,758,144 and 4,154,470, all of which issued to Herbert F. Dalglish.

A problem often encountered with the lifting and maneuvering of such heavy rolls of material is the transfer from the lifting apparatus to the shaft of a coil winding/unwinding machine. Typically, such a machine includes a rotatable shaft that is horizontally disposed and supported in cantilever fashion. The roll is maneuvered by the lifting apparatus so that its axis is horizontally disposed, and the lifting apparatus is thereafter brought to the winding/unwinding machine with the center probe of the lifting apparatus and the shaft of the machine in coaxial alignment.

Assuming that the operator can maintain the lifting apparatus in this aligned position, the roll is then physically transferred from the lifting apparatus to the shaft by physical strength. If the roll is particularly heavy, more than one operator may be necessary to push the roll from the lifting apparatus to the machine shaft. This task is not only difficult because of the size and weight of the rolls, but it is also difficult and dangerous. Alignment of the machine shaft with the center probe is easily lost, and if the lifting apparatus is supported from a single point on an overhead crane, continued registration is particularly difficult. Further, even when the center probe and machine shaft are aligned, it is possible for the roll to be dropped from its elevated position during the transfer process, and this is always dangerous to the operator or operators involved.

SUMMARY OF THE INVENTION

The present invention is the result of an endeavor to overcome these problems.

The invention is embodied in a roll lifting apparatus of the type disclosed in the aforementioned U.S. Pat. No. 4,154,470. This apparatus is particularly suited for suspension from a movable overhead crane, and includes a center probe that may be moved by an actuator between substantially horizontal and substantially vertical positions. Mechanical retention means are associated with the probe that increase its effective diameter after the probe has been inserted into the actual core opening, permitting the roll to be lifted from either a vertical or horizontal at-rest position.

The invention resides in the combination with the roll lifting apparatus of means for engaging the lifted roll and forcing it from the center probe after alignment with a machine shaft or the like has been achieved. In the preferred embodiment, the inventive apparatus includes coupling means for releasably connecting the center probe and machine shaft together before the transfer operation begins.

In the preferred embodiment, the roll transfer or unloading device comprises a large, circular plate that is concentrically disposed in encircling relation to the center probe and axially movable relative thereto between a retracted position in which the roll of material may be received, and an extended position in which the roll is forceably transferred from the probe. The circular plate is provided with means for creating a vacuum between the plate and the roll end, which serves to assist the mechanical roll retention means associated with the probe means, and also to preclude telescoping of the material on the roll.

The circular vacuum plate is moved between the retracted and extended positions by a plurality of pneumatic actuators that are carried by the main frame and operable by the operator through a control valve.

Preferably, the coupling means comprises a first coupler disposed at the end of the center probe and a second coupler adapted for connection to the machine shaft. The two couplers matably interlock by dropping the first coupler end from above into the second coupler. This provides a strong interlocking engagement, maintaining the center probe and machine shaft in coaxial relation, but also permits simple release by raising the roll lifting apparatus after roll transfer has been accomplished.

Preferably, the first coupler is spring loaded into a projecting position and retractable within the center probe when it engages a fixed object, such as the floor or other supporting surface for the roll. Thus, for example, if the roll of material is being stored on one end (i.e., with the core axis vertically disposed), the center probe is inserted until the vacuum plate engages the top end of the roll. Where the roll is of lesser axial length than the center probe, the first coupler will engage the floor or other roll supporting surface and withdraw into the center probe until the roll is lifted from the supporting surface. As the roll is lifted, the first coupler projects beyond the end of the roll, thus insuring that it will be exposed for coupling with the second coupler.

With the use of the inventive apparatus, a single operator may lift a heavy roll of material from its supporting surface, maneuver it adjacent the machine shaft to which the roll is to be transferred, cause the probe and shaft to be coupled and transfer the roll from the center probe to the machine shaft quickly and efficiently.

BRIEF DESCRIPTION OF THE DRAWING

FIG. 7 is an enlarged fragmentary perspective view of the extreme end of the probe assembly disposed for coupling relationship with a transfer shaft; and FIG. 8 is a further enlarged fragmentary sectional view of the probe assembly and transfer shaft in coupled relation.

DESCRIPTION OF THE PREFERRED EMBODIMENT

Figure 1:
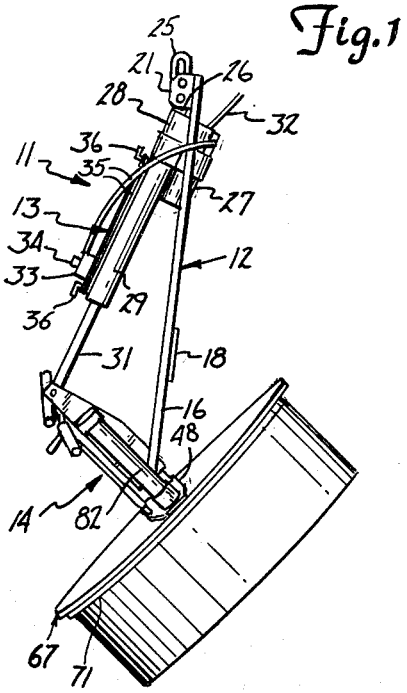
FIG. 1 is a perspective view of the inventive roll lift and transfer apparatus suspended from an overhead crane.
Figure 2:
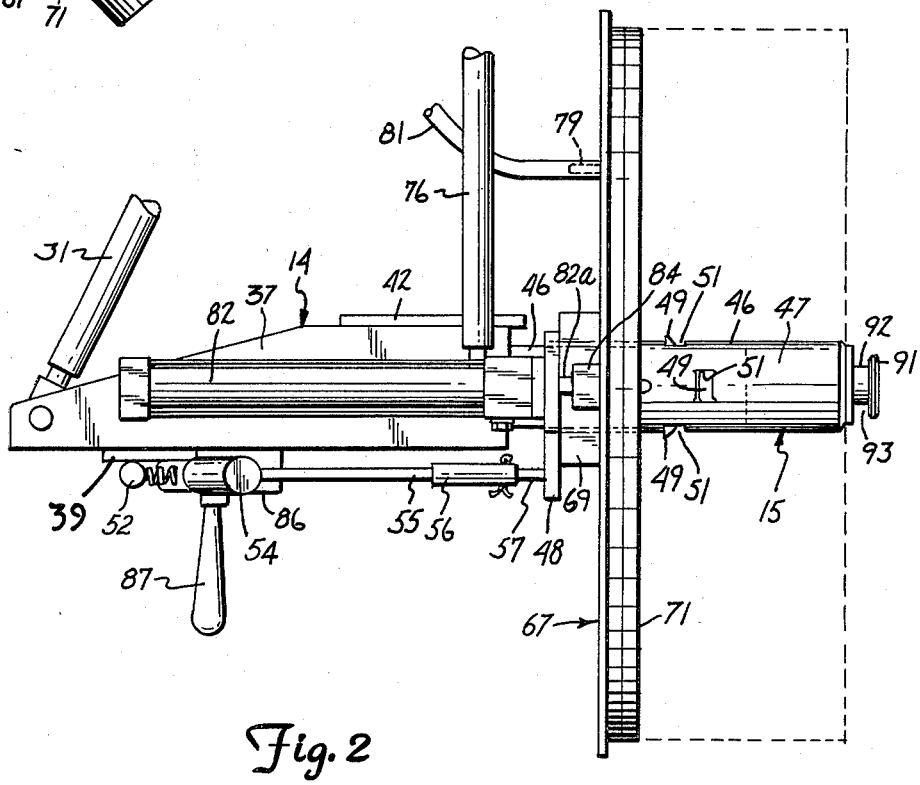
FIG. 2 is an enlarged fragmentary view of the inventive apparatus in side elevation, with portions of the frame assembly broken away.
Figure 3:
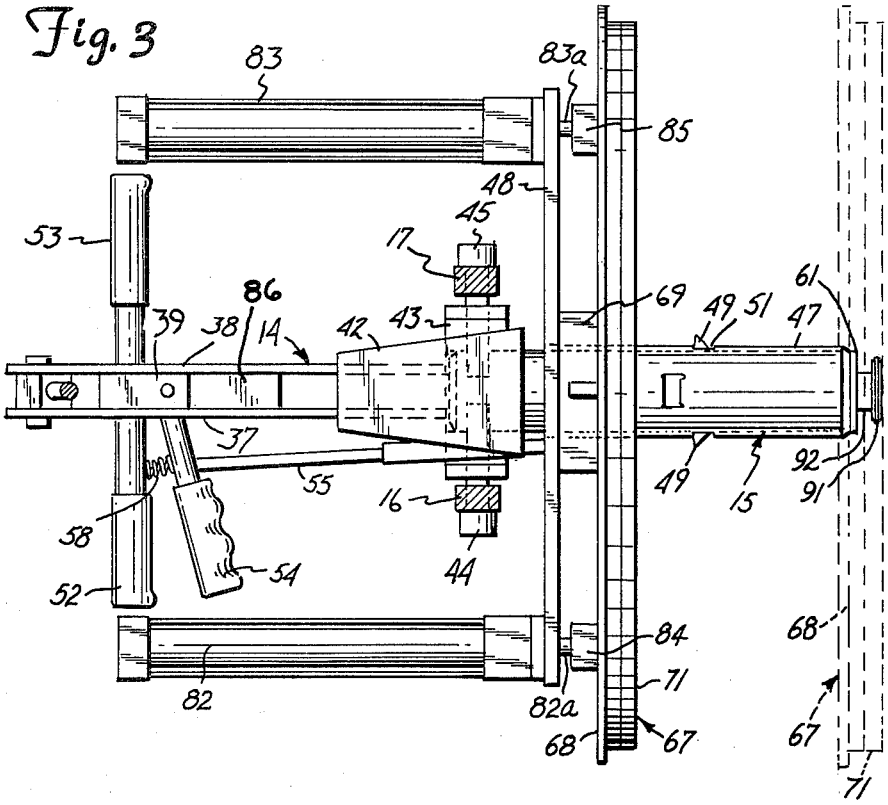
FIG. 3 is a view similar to FIG. 2 but in top elevation of the inventive apparatus.

With initial reference to FIGS. 1-3, a roll lift and transfer apparatus is represented generally by the numeral 11. Apparatus 11 comprises an elongated frame 12, an elongated actuator 13 that is pivotally connected at its upper end to the elongated frame 12 and a torque arm assembly 14. The rear end of the torque arm assembly is pivotally connected to the lower end of the elongated actuator 13. The elongated frame 12 is pivotally connected to the torque arm assembly 14 so that extension and retraction of the actuator 13 causes the torque arm assembly 14 to swivel between substantially vertical and substantially horizontal positions.

A probe assembly bearing the general reference numeral 15 (FIGS. 2 and 3) projects axially forward from the torque arm assembly 14, and as described in further detail below, is constructed for insertion into and retainable engagement with the core of a roll to be lifted.

Apparatus of this type is disclosed and claimed in U.S. Pat. No. 4,154,470, which issued to Herbert F. Dalglish on May 15, 1979.

The elongated frame assembly 12 specifically comprises a pair of elongated frame members 16, 17 that are rigidly held in spaced, parallel relation by a rectangular plate 18 (FIG. 1) and the pivotal connection to the torque arm assembly (FIG. 3).

Figure 1A:
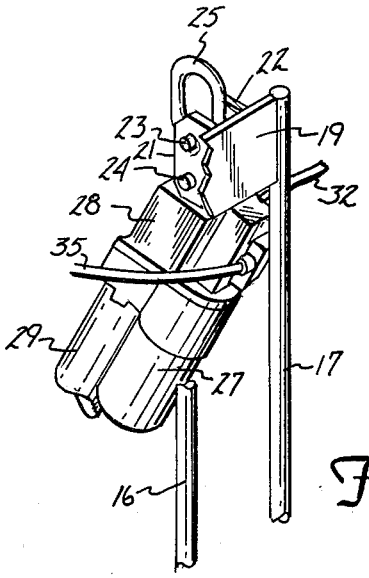
FIG. 1A is an enlarged fragmentary view of the upper end of the inventive apparatus.

With additional reference to FIG. 1*a*, a second rectangular plate 19 is welded between the frame members 16, 17 at their upper end. A pair of smaller plate members 21, 22 are welded to the rear side of plate 19, projecting perpendicularly therefrom in spaced relation. Two pairs of aligned bores are formed in the plates 21, 22 and respectively receive transverse pivot pins 23, 24. The upper pin secures an end link 25 used for connecting the apparatus to an overhead crane or the like.

The lower pivot pin 24 serves as the pivotal connection between the frame 12 and actuator 13. This is accomplished by securing a lug 26 to the upper end of the actuator 13 with a transverse bore through which the lower pivot pin 24 projects.

Actuator 13 comprises a reversible electric motor 27 that is carried within a housing 28. The pivot lug 26 is secured to the housing 28.

A tubular body 29 projects downwardly from the housing 28 adjacent the electric motor 27. An extensible and retractable tube 31 is slidably carried within the tubular body 29. Extension and retraction of the tube 31 is effected through a gearing arrangement (not shown) including a gear and pinion set coupled to a jack screw and nut that travels with the extensible tube. The actuator further includes a bidirectional brake that prevents movement when the motor is not turning, and a slip clutch that protects the actuator from overload. Reference is made to U.S. Pat. Nos. 3,559,499, 3,587,796 and 3,704,765 for further details of the actuator.

Motor 27 is energized through an electric power line 32 and control of the motor is accomplished through a control box 33 having a forward/reverse switch 34. Control box 33 is removably mounted on the tubular body 29, and is connected to the motor 27 through an electric control line 35. Control line 35 is of sufficient length to permit removal of the control box 33 from the unit for remote control purposes. When the control box 33 is in its mounted position, the control line 35 is wound on a pair of brackets 36 suitably mounted on the tubular body 29.

With reference to FIGS. 2 and 3, the torque arm assembly 14 comprises a pair of heavy, elongated plate members 37, 38 that are held in spaced, parallel relation by a rectangular plate 39 that is welded on the bottom edges thereof, and a larger plate 42 having tapered sides that is welded to the top edges thereof. The tapered plate member 42 extends axially beyond the ends of the elongated plates 37, 38, and a collar block 43 underlies the plate 42, being welded thereto as well as the ends of the elongated plates 37, 38.

As best shown in FIG. 3, the lower ends of the spaced frame members 16, 17 of elongated frame 12 are pivotally secured to the collar lock 43 by bolts 44, 45, respectively.

Figure 6:
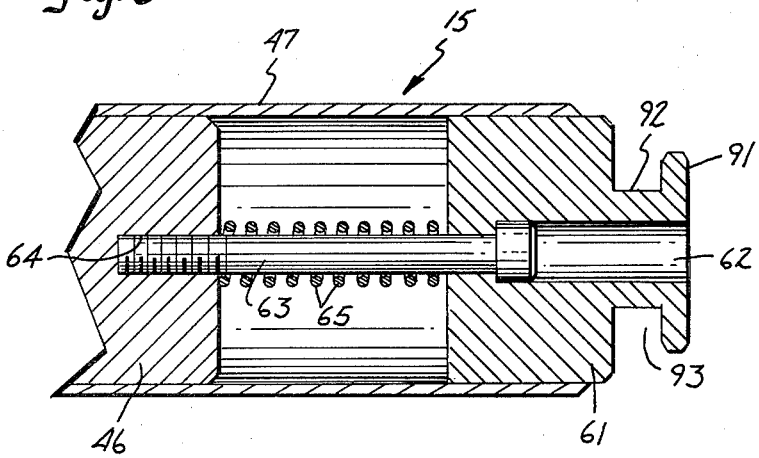
FIG. 6 is a further enlarged fragmentary sectional view of the extreme end of the probe assembly.

With reference to FIGS. 2, 3 and 6, the probe assembly 15 comprises a stationary cylindrical member 46 one end of which is rigidly secured to the collar block 43 by the bolts 44, 45 (FIG. 3). The probe assembly 15 further comprises a cylindrical shell or sleeve 47 that is sized for sliding movement axially of the cylindrical member 46. The rear end of the cylindrical sleeve 47 is secured to an elongated plate 48 that is transversely disposed of the probe assembly axis. As constructed, the cylindrical sleeve 47 and elongated plate 48 are capable of axial movement together relative to the stationary cylindrical member 46.

A plurality of teeth 49 of angular cross section are carried by the cylindrical member 46 for rockable movement radially inward and outward. In their radially outermost positions (FIGS. 2 and 3), the teeth 49 project through appropriately disposed window openings 51 in the cylindrical sleeve 47. The teeth 49 are normally urged radially inward by resilient means (not shown) so as to be withdrawn from the openings 51. As shown in FIGS. 2 and 3, the forward side of each tooth 49 is angular, so that rearward sliding movement of the sleeve 47 relative to the cylindrical member 46 enables each tooth 49 to rock within the associated opening 51 and thereby retract under the influence of the resilient means. In this position, the lower internal edge of the opening 51 is maintained in contact with the retracted tooth 49 even though it is radially withdrawn. Locking means may be included to maintain the sleeve in this position.

Forward sliding movement of the sleeve 47 causes the edge of the associated opening 51 to move against the transverse rearward edge of each tooth 49, causing it to rock forwardly against the bias of the resilient means and to project from its associated opening 51 for engagement with the core of the roll to be lifted. Reference is made to U.S. Pat. No. 3,423,120, which issued to Herbert F. Dalglish on Jan. 21, 1969 for further details of the structure and operation of probe assemblies of this type.

With continued reference to FIGS. 2 and 3, a pair of stationary handles 52, 53 are rigidly secure to the underside of plate 39 to permit an operator to maneuver the apparatus 11. As shown in FIG. 3, the handles 52, 53 extend transversely of the torque arm assembly 14.

Pivotally mounted to the underside of torque arm assembly 14 (at plate 39) is a third handle 54 that is disposed just forward of the handle 52. An elongated linkage rod 55 has one end pivotally connected to the handle 54 at an intermediate point thereof, with the other end extending forwardly for slidable insertion into a cylindrical connector 56 (FIG. 2). The forward end of connector 56 is pivotally connected to an ear 57 that is secured to the elongated plate 48. Internally of the connector 56 is a spring and spring retainer (not shown) the purpose of which is to normally urge the linkage rod 55 and handle 54 forwardly. This function is assisted by a coil spring 58 which is compressibly disposed between the handles 52 and 54 (FIG. 3).

As constructed, squeezing the handle 54 relative to the handle 52 draws the linkage rod 55 rearwardly, which in turn retracts the elongated plate 48 and cylindrical sleeve 47 relative to the stationary cylindrical member 46. This permits the teeth 49 to rock radially inward out of engagement with the lifted roll.

With reference to FIG. 6, the stationary cylindrical member is considerably shorter than the cylindrical sleeve 47, but its effective length is extended by a coupler 61. Coupler 61 has a diameter the same as that of the cylindrical member 46, and it is also slidably disposed within the cylindrical sleeve 47. However, it is normally retained in the position shown in FIG. 6; viz., projecting beyond the end of sleeve 47.

Coupler 61 is capable of retraction into the cylindrical sleeve 47. It is formed with a blind axial bore 62 sized to receive the head of an elongated bolt 63. Bolt 63 is screwed into a threaded bore 64 extending axially in the end of cylindrical member 46. A spring 65 is disposed in compression between the cylindrical members 46 and the coupler 61, urging the coupler 61 into its projecting position as shown. However, if the coupler 61 engages another object (e.g., the floor when the probe assembly 15 is moving vertically downward), it will retract into the cylindrical sleeve 47.

With reference to FIGS. 2–5, a large, circular vacuum plate assembly is represented generally by the numeral 67. The assembly 67 comprises an annular backing plate 68 through which a flanged hub member 69 projects rearwardly. The inside diameter of the hub 69 corresponds to the external diameter of the sleeve 47, permitting the assembly 67 to slide axially of the probe assembly 15.

A composite circular flange 71 projects forwardly from the periphery of annular plate 68. The flange 71 comprises an underlying support section formed from the same material as the annular plate 68 (preferably cast metal) and a seal formed from a resilient material such as rubber.

A second circular seal 72 is secured to the periphery of the hub member 69. The outer faces of the seals 71, 72 lie in the same plane, and with contact with a planar surface (such as the end of a roll of material), an annular vacuum chamber is defined thereby.

Figure 4:
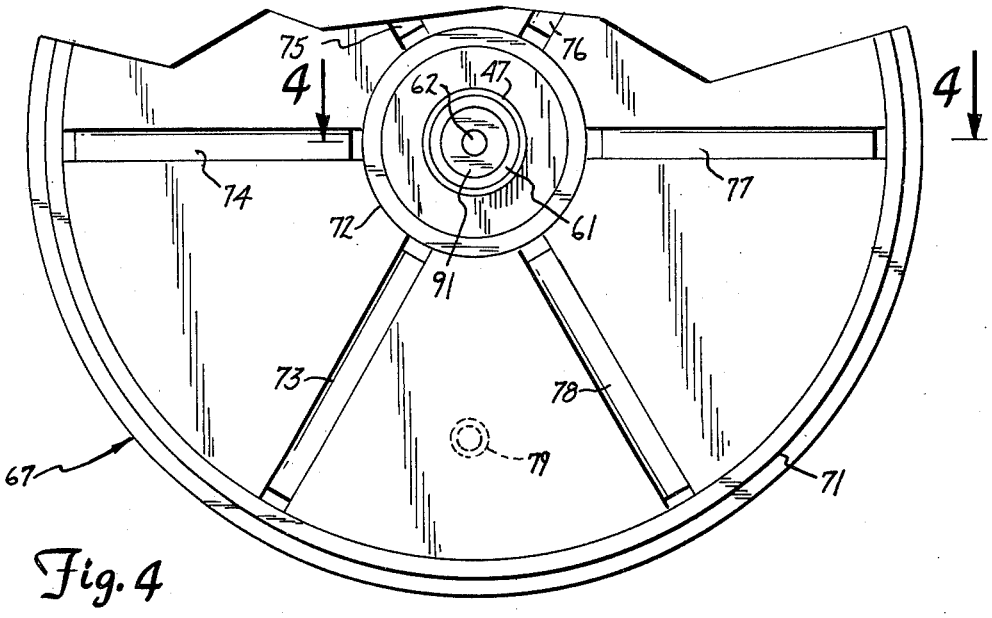
FIG. 4 is an enlarged fragmentary view of the probe assembly and slidable vacuum plate of the inventive apparatus.
Figure 5:
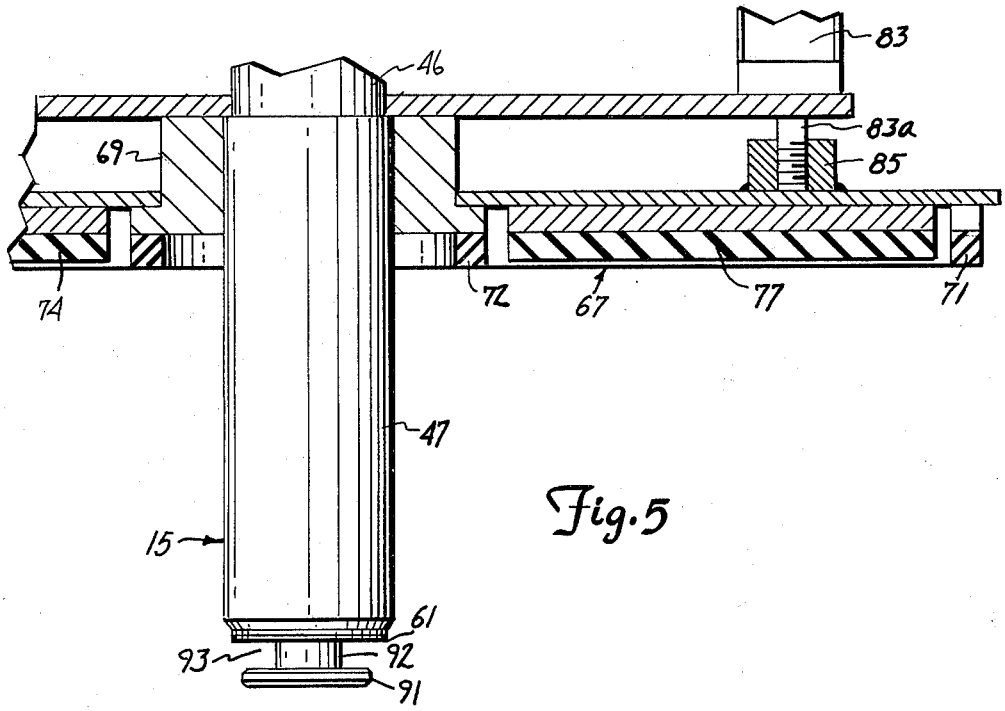
FIG. 5 is a sectional view taken along the line 4—4 of FIG. 4.

Extending radially between the seals 71, 72 are a plurality of composite ribs 73–78, each of which comprises an underlying support section and a resilient sealing strip. However, as shown in FIG. 4, the ends of each of the ribs 73–78 is spaced from the respective seals 71, 72 to permit vacuum communication throughout the annular vacuum chamber when contact with the end of a roll of material is made. Further, and as best shown in FIG. 5, the axial dimension or thickness of the ribs 73–78 is slightly less than that of the seals 71, 72. This permits a full communication of vacuum, while resisting telescoping of the roll of material radially within the annular vacuum chamber.

With reference to FIGS. 2 and 4, a nipple 79 projects from the rear surface of the annular plate 68 and communicates with the annular vacuum chamber. A hose 81 connects the nipple 79 with a source of vacuum.

Reference is made to the aforementioned U.S. Pat. No. 3,758,144, which discloses a vacuum center lift of this general type.

With reference to FIGS. 2, 3 and 5, a pair of pneumatic actuators 82, 83 are mounted at the outboard end of the elongated plate 48, projecting rearwardly therefrom. The actuator 82 includes an extensible rod **82*a* that projects through the plate 48 and is threaded into a connector 84 welded to the back face of annular backing plate 68. Actuator 83 has a similar rod 83*a* connected to a connector 85**.

As constructed, the actuators 82, 83 are employed to force the vacuum plate assembly 67 axially between a first retracted position (see the full lines in FIG. 3) in which a roll of material may be received on the probe assembly 15, and an extended position (see the phantom lines in FIG. 3) in which the roll of material is forced off the probe assembly 15. The stroke of the actuators 82, 83 is chosen as a function of the length of the probe assembly 15 so that the vacuum plate assembly 67 does not extend beyond the probe assembly 15.

Extension and retraction of the pneumatic actuators 82, 83 is controlled by a conventional control valve 86 mounted to the bottom edges of plates 37, 38 adjacent the plate 39, and having a manually operable handle 87. Valve 86 is adapted for connection to a source of air under pressure and communicates with each of the actuators 82, 83 through a pair of supply/return lines (not shown). Handle 87 is operable to control valve 86 from a neutral position (the position shown in FIG. 2) to extension and retraction positions in which the actuators 82, 83 are respectively extended and retracted. Preferably, the handle 87 is normally biased to the neutral position.

With reference to FIGS. 6–8, coupler 61 defines a circular flange 91 at its extreme end of predetermined diameter and which is centered on the axis of the probe assembly 15. The flange 91 is spaced from the main body of coupler 61 by a stepped region 92 of lesser diameter that defines a circumferential groove 93.

With specific reference to FIGS. 7 and 8, the shaft of a winding/unwinding machine to which the roll of material is to be transferred bears the general reference numeral 93. The extreme end of the shaft 93 is provided with a mating coupler 94 consisting of an annular segment 95 welded to the end of the shaft 93. As shown in FIG. 8, shaft 93 is tubular, and the upper edge of its extreme outer end is formed with a beveled surface 96 to facilitate entry of the flange 91 into its defined slot.

Also as shown in FIG. 8, the outside diameter of circular flange 91 is less than the inside diameter of the shaft 93, and the diameter of the stepped region 92 corresponds to the inner diameter of the annular segment 95 to provide a snug fit. With the couplers 61, 94 in coupling engagement, the probe assembly 15 and shaft 93 are coaxially disposed.

In operation, the apparatus 11 is suspended from a movable overhead crane or the like as shown in FIG. 1. To lift a vertically stacked roll of material and transfer it to a winding/unwinding machine, the operator first operates the switch 34 in control box 33 to retract actuator 13. This causes the torque arm assembly 14 and probe assembly 15 to assume a substantially vertical position with the probe assembly 15 pointing down.

The overhead crane is then operated to orient the apparatus 11 over the selected roll of material. At this point, the handle 54 is squeezed relative to the handle 52 to cause retraction of the teeth 49, and the crane is lowered so that the probe assembly 15 enters the core of the roll. As the probe extends, the coupler 61 engages the floor or other supporting surface of the roll and withdraws or retracts into the sleeve 47 against the bias of spring 65.

When the vacuum plate assembly 67 engages the end of the roll, the handle 54 is released and the teeth 49 are forced radially outward into a position biting into the inner surface of the roll core. Also at this time, vacuum is applied through the hose 81 to the vacuum plate assembly 67 to insure that the roll of material will not telescope as it is raised.

The crane is at this time operated so that the roll of material is lifted from its supporting surface, at which time the spring 65 urges the coupler 61 outward to project beyond the roll. The operator then actuates the switch 34 of the control box 33 to extend the actuator 13 and move the torque assembly 14 and probe assembly 15 to a substantially horizontal position.

At this point, the crane is operated to move the apparatus 11 and roll of material adjacent the shaft 93 to which the roll is to be transferred. The desired position of the roll of material, which is facilitated by the operator maneuvering the apparatus 11 with the handles 52, 53, is with the projecting coupler 61 slightly above the mating coupler 94, and with the probe assembly 15 and shaft 93 otherwise in general alignment. The crane is then lowered slightly so that the couplers 61, 94 matably engage with the probe assembly 15 and shaft 93 disposed in coaxial relation.

The operator now releases the vacuum from vacuum assembly 67 and squeezes the handle 54 relative to the handle 52 to retract the teeth 49 in preparation for the roll transfer. The transfer is achieved by moving handle 87 to the extend position, which pressurizes the pneumatic actuators 82, 83, causing them to extend and drive the vacuum plate assembly 67 axially over the probe assembly. This moves the roll of material from the probe assembly onto the shaft 93.

With the transfer complete, the valve 86 is operated by handle 87 to retract actuators 82, 83. At this point, the crane is raised to disengage coupler 61 from coupler 94, and the apparatus 11 is moved away for further operations.

Transfer of a roll of material from the shaft 93 to the apparatus 11 is simply the reverse of the procedure described above.

It will be appreciated that the apparatus 11 may be operated to lift a roll resting on its side on a supporting surface (i.e., with its axis horizontal), or to leave a roll of material on its side on the supporting surface. This is accomplished by leaving the actuator 13 in its extended position so that the torque assembly 14 and probe assembly 15 are always substantially horizontally disposed. Reference is made to U.S. Pat. No. 4,154,470 with regard to the improved function of apparatus of this type in avoiding damage to the edge of a roll.

As described hereinabove, it will be appreciated that the apparatus 11 is capable of lifting and transferring a roll of material of substantial weight through simple manipulation of a single operator with speed and efficiency, and without danger to the operator.

What is claimed is:

1. Apparatus for loading and unloading a roll of material having an externally accessible opening to and from an independently supported shaft, comprising:

(a) frame means;

(b) probe means projecting from the frame means and constructed for insertion into the roll opening;

(c) retention means associated with the probe means for releasably retaining the roll thereon;

(d) coupling means for releasably connecting the probe means with said independently supported shaft with the probe means and shaft in coaxial alignment and for preventing relative axial movement therebetween when connected;

(e) and roll unloading means movably carried by the frame means for forcing the roll axially from the probe means onto the shaft.

2. The apparatus defined by claim 1, wherein the roll unloading means comprises:

(a) roll engaging means carried by the frame means for movement longitudinally of the probe means between a retracted position in which the roll may be received on the probe means and an extended position in which the roll is forced from the probe means;

(b) and actuator means for moving the roll engaging means between the extended and retracted positions.

3. The apparatus defined by claim 2, wherein the roll engaging means comprises plate means having one surface adapted to engage the end of the roll, the plate means being disposed in encircling relation to the probe means.

4. The apparatus defined by claim 3, wherein the plate means includes means for creating a vacuum between the plate means and the end of the roll, said plate means being for connection with a source of vacuum.

5. The apparatus defined by claim 3, wherein the actuator means are fluid actuated.

6. The apparatus defined by claim 3, wherein the actuator means comprises at least one pneumatic actuator operably connected to the plate means, and valve control means for causing extension and retraction of the actuator.

7. The apparatus defined by claim 3, wherein the plate means is circular in configuration.

8. The apparatus defined by claim 1, wherein the coupling means comprises first and second couplers constructed for matable engagement, the first coupler being mounted on the extreme end of the probe means, and the second coupler adapted for mounting on the extreme end of the independently supported shaft.

9. The apparatus defined by claim 8, wherein one of said couplers comprises a main body and a flange spaced therefrom by a stepped down portion, and the second coupler defines a receptacle into which the flange may be interlockably disposed.

10. The apparatus defined by claim 9, wherein the first coupler is carried by the probe means for movement between a normal extended position and a retracted position within the probe means.

11. The apparatus defined by claim 10, which further comprises spring means for normally biasing the coupling means to said extended position.

12. The apparatus defined by claim 1, wherein the coupling means is disposed at the extreme end of the probe means, and is carried thereby for movement between a normal extended position and a retracted position within the probe means.

13. The apparatus defined by claim 12, which further comprises spring means for normally biasing the coupling means to said extended position.

14. The apparatus defined by claim 1, wherein the retention means comprises mechanical means for increasing the external sides of the probe means within the roll opening for retainably engaging the roll.

15. The apparatus defined by claim 14, wherein:

(a) the probe means defines a predetermined axis and comprises
  (i) a cylindrical member carried by the frame means; and
  (ii) a cylindrical sleeve encircling the cylindrical member and slidable relative thereto;
(b) and the mechanical means comprises a plurality of teeth retainably carried within the cylindrical member and projectable through registering openings in the cylindrical sleeve, the teeth being constructed and arranged to project and retract with relative movement between the cylindrical member and sleeve.

16. The apparatus defined by claim 15, wherein the cylindrical sleeve is carried by a support member disposed transversely of the probe means axis, the support member being carried for axial movement by the frame means; and further comprising manually operable means carried by the frame means for moving the cylindrical member to effect projecting and retracting movement of the teeth.

17. The apparatus defined by claim 16, wherein the roll unloading means comprises:

(a) roll engaging means carried by the frame means for movement longitudinally of the probe means between a retracted position in which the roll may be received on the probe means and an extended position in which the roll is forced from the probe means;
(b) and actuator means for moving the roll engaging means between the extended and retracted positions.

18. The apparatus defined by claim 17, wherein the actuator means are carried by said transversely disposed support member, and the roll engaging means is disposed between the support member and the end of the probe means.

19. Apparatus for handling a roll of material having an externally accessible axial opening comprising:

(a) an elongated frame having upper and lower ends and adapted to be raised and lowered by an overhead crane or the like;
(b) torque assembly means including probe means having first and second ends, the first end being associated with the probe means and constructed for insertion into the roll opening, the probe means including retention means for releasably retaining the roll thereon;
(c) said torque assembly means being pivotally connected intermediate its first and second ends to the lower end of the elongated frame and swingable between a generally vertical position and a transverse lift position;
(d) first actuator means operatively connected between said elongated frame and the torque assembly means proximate its second end for moving the torque assembly means from the generally vertical position to the transverse lift position, and for maintaining the torque assembly means in either position, whereby the roll may be lifted from a horizontal or vertial position;
(e) coupling means disposed at the extreme end of the probe means for releasably connecting the probe means to an independently supported transfer shaft in coaxial alignment, and for preventing relative axial movement therebetween when connected;
(f) circular plate means concentric with the probe means and axially movable relative thereto between a retracted position in which the roll may be received on the probe means and an extended position in which the roll is forceably transferred from the probe means;
(g) and actuator means carried by the torque assembly means for moving the plate means between the retracted and extended positions.

20. The apparatus defined by claim 19, wherein the plate means includes means for creating a vacuum between the plate means and the end of the roll, said plate means being adapted for connection with a source of vacuum.

21. The apparatus defined in claim 19, wherein the coupling means is carried by the probe means for movement between a normal extended position and a retracted position within the probe means.

22. Apparatus for loading and unloading a roll of material having an externally accessible opening to and from an independently supported shaft, comprising:

(a) frame means;
(b) probe means projecting from the frame means and constructed for insertion into the roll opening;
(c) retention means associated with the probe means for releasably retaining the roll thereon;
(d) coupling means for releasably connecting the probe means with said independently supported shaft with the probe means and shaft in coaxial alignment;
(e) said coupling means being disposed at the extreme end of the probe means and carried thereby for movement therebetween a normal extended position and a retracted position within the probe means;
(f) and roll unloading means movably carried by the frame means for forcing the roll axially from the probe means onto the shaft.

23. The apparatus defined by claim 22, which further comprises spring means for normally biasing the coupling means to said extended position.

* * * * *

UNITED STATES PATENT AND TRADEMARK OFFICE

CERTIFICATE OF CORRECTION

PATENT NO. :4,358,143

DATED :November 9, 1982

INVENTOR(S) :Ralph E. Cullen

It is certified that error appears in the above-identified patent and that said Letters Patent is hereby corrected as shown below:

Column 10, line 15, "vertial" should read -- vertical --.

Signed and Sealed this

*Twenty-fourth* Day of *May 1983*

[SEAL]

*Attest:*

DONALD J. QUIGG

*Attesting Officer* *Acting Commissioner of Patents and Trademarks*